US009662893B2

(12) United States Patent
Mori et al.

(10) Patent No.: US 9,662,893 B2
(45) Date of Patent: May 30, 2017

(54) PRINTING APPARATUS

(71) Applicant: SEIKO EPSON CORPORATION, Tokyo (JP)

(72) Inventors: Kazunori Mori, Nagano (JP); Seiichi Taniguchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/080,713

(22) Filed: Mar. 25, 2016

(65) Prior Publication Data

US 2016/0303860 A1 Oct. 20, 2016

(30) Foreign Application Priority Data

Apr. 16, 2015 (JP) ..... 2015-083976

(51) Int. Cl.
*B41J 2/175* (2006.01)

(52) U.S. Cl.
CPC ..... *B41J 2/17523* (2013.01); *B41J 2/17509* (2013.01); *B41J 2/17513* (2013.01); *B41J 2/17553* (2013.01); *B41J 2/17596* (2013.01)

(58) Field of Classification Search
CPC ..... B41J 2/17523; B41J 2/17596
See application file for complete search history.

(56) References Cited

U.S. PATENT DOCUMENTS

| | | | | |
|---|---|---|---|---|
| 5,974,971 | A | 11/1999 | Moller et al. | |
| 2003/0142176 | A1* | 7/2003 | Wu | B41J 2/175 347/85 |
| 2004/0139868 | A1 | 7/2004 | Arai et al. | |
| 2006/0197812 | A1* | 9/2006 | Murakami | B41J 2/17596 347/84 |
| 2013/0169720 | A1* | 7/2013 | Nakamura | B41J 2/175 347/86 |
| 2013/0335466 | A1* | 12/2013 | Olsen | B41J 2/175 347/7 |

FOREIGN PATENT DOCUMENTS

| | | | |
|---|---|---|---|
| JP | 11-240138 | A | 9/1999 |
| JP | 2002-046338 | A | 2/2002 |
| JP | 2004-237722 | A | 8/2004 |
| JP | 2009-066940 | A | 4/2009 |
| JP | 2012-152995 | A | 8/2012 |

* cited by examiner

*Primary Examiner* — Alessandro Amari
*Assistant Examiner* — Roger W Pisha, II
(74) *Attorney, Agent, or Firm* — Global IP Counselors, LLP

(57) ABSTRACT

A printing apparatus includes an ink tank that has a fill port for a user to pour in ink through, a printing mechanism that performs printing by using ink stored in the ink tank, and a float that floats in the ink in the ink tank. The fill port or a pour port of an ink container is closed as the float floats up.

8 Claims, 10 Drawing Sheets

PRINTING APPARATUS

CROSS REFERENCES TO RELATED APPLICATIONS

The entire disclosure of Japanese Patent Application No. 2015-083976, filed Apr. 16, 2015 is incorporated by reference herein.

BACKGROUND

1. Technical Field

The present invention relates to a printing apparatus.

2. Related Art

An ink jet printer, an example of the printing apparatuses, is equipped with an ink tank that contains ink and that supplies ink to a liquid ejecting head. The ink supplied to the liquid ejecting head is ejected to a recording medium such as a print sheet to execute printing. As printing is executed, the ink inside the ink tank is consumed. Therefore, an ink jet printer in which an ink tank is replenished with ink housed in an ink container exists (e.g., JP-A-2012-152995).

Such an ink tank is provided with a fill port. To replenish the ink tank with ink, a user pours ink from the ink container through the fill port.

However, at the time of pouring ink, ink can sometimes be excessively put into the ink tank.

SUMMARY

Advantages of some aspects of the invention can be achieved by, for example, the following forms or embodiments.

Aspect 1

According to an aspect of the invention, a printing apparatus includes an ink tank that has a fill port for a user to pour in ink through, a printing mechanism that performs printing by using ink stored in the ink tank, and a float that floats in the ink in the ink tank. In the printing apparatus, the fill port is closed as the float floats up.

According to this aspect, the fill port is closed as the float floats up. Therefore, at the time point when a proper amount of ink is poured into the ink tank, the pour of ink is stopped. Therefore, it is not necessary to monitor the position of the liquid surface in the ink tank in order to prevent an incident in which ink overflows from the fill port of the ink tank.

Aspect 2

The foregoing printing apparatus may further include a projected portion for opening a self-sealing valve of an ink container set to the fill port, the projected portion being provided above the fill port.

According to this embodiment, because the self-sealing valve of the ink container is opened when the ink container is set to the fill port, it is possible to prevent an incident in which ink is spilled around the fill port when a user tilts the ink container to start pouring in ink. Furthermore, when the ink container is detached from the fill port after the fill port is closed as the float floats up, the self-sealing valve of the ink container closes, so that the incident of the ink being spilled around the fill port can be prevented.

Aspect 3

The foregoing printing apparatus may further include a guide member that guides the float upward in a vertical direction.

According to this embodiment, the float is guided to the fill port.

Aspect 4

Furthermore, in the foregoing printing apparatus, the float may close the fill port by contacting the fill port.

According to this embodiment, the float functions as a valve for closing the fill port, so that the closure of the fill port can be achieved by a simple configuration.

Aspect 5

In this printing apparatus, a site at the fill port with which the float comes into contact may be provided with an elastic member that enables tight closure with the float.

According to this embodiment, the tightness of closure of the fill port with the float improves.

Aspect 6

The printing apparatus may further include a pivoting member whose pivot fulcrum is fixed in the ink tank, and the float may be fixed to the pivoting member at a position apart from the pivot fulcrum, and by a principle of leverage, an acting force converted from a buoyant force on the float causes the fill port to be closed.

Aspect 7

According to another aspect of the invention, a printing apparatus includes an ink tank that has a fill port for a user to pour in ink through, a printing mechanism that performs printing by using ink stored in the ink tank, and a float that floats in the ink in the ink tank. The pour port of the ink container set to the fill port is closed as the float floats up.

According to this aspect of the invention, the pour port of the ink container set to the fill port is closed as the float floats up. Therefore, at the time point when a proper amount of ink is poured into the ink tank, the pour of ink is stopped. Therefore, it is not necessary to monitor the position of the liquid surface in the ink tank in order to prevent an incident in which ink overflows from the fill port of the ink tank.

Aspect 8

The foregoing printing apparatus may further include a pivoting member whose pivot fulcrum is fixed in the ink tank, and the float may be fixed to the pivoting member at a position apart from the pivot fulcrum, and by a principle of leverage, an acting force converted from a buoyant force on the float may cause the fill port to be closed.

According to this embodiment, by the principle of leverage, the acting force for closing the pour port can be made greater than the buoyant force on the float. Therefore, the volume of the float can be made small.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings.

Embodiment 1

Figure 1A:
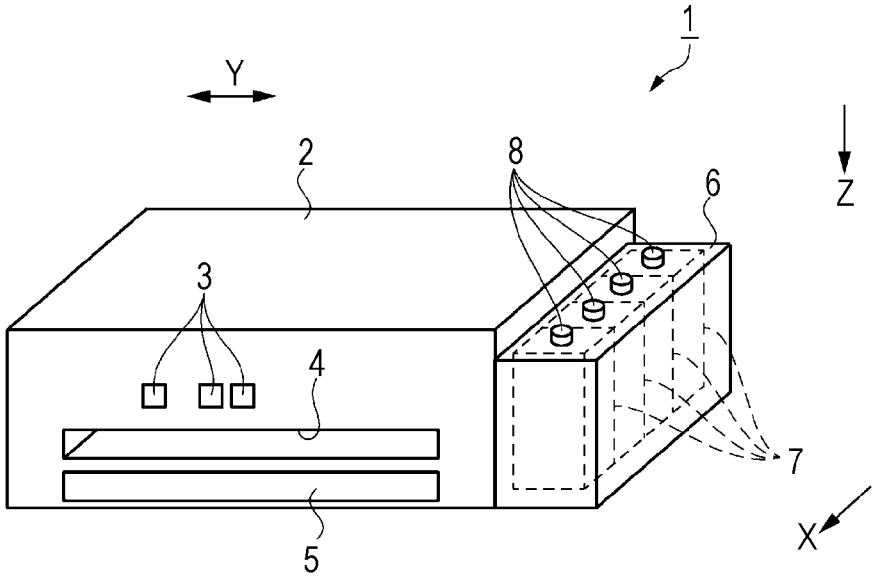
FIG. 1A is an external perspective view of a printing apparatus and FIG. 1B is an illustrative diagram schematically showing an internal structure of the printing apparatus.

FIG. 1A is an external perspective view of an ink jet printer (hereinafter, referred to as printer) 1 as an example of the printing apparatus of the invention. A body case 2 has a substantially box-like external shape. A front side of the body case 2 is provided with a plurality of operation buttons 3, a sheet cassette 5, and a sheet discharge port 4.

The sheet cassette 5 is capable of being pulled out to the front surface side and housing a stack of sheets (not shown in the drawings). When a user operates one of the operation buttons 3, a sheet is fed from the sheet cassette 5. After a surface of the sheet is printed with characters or an image inside the body case 2, the sheet is discharged from the sheet discharge port 4.

A side surface of the body case 2 which is shown at the right side in the drawing is provided with a tank case 6. Inside the tank case 6 there are housed four ink tanks 7 that separately contain yellow, magenta, cyan, and monochrome inks.

Figure 1B:
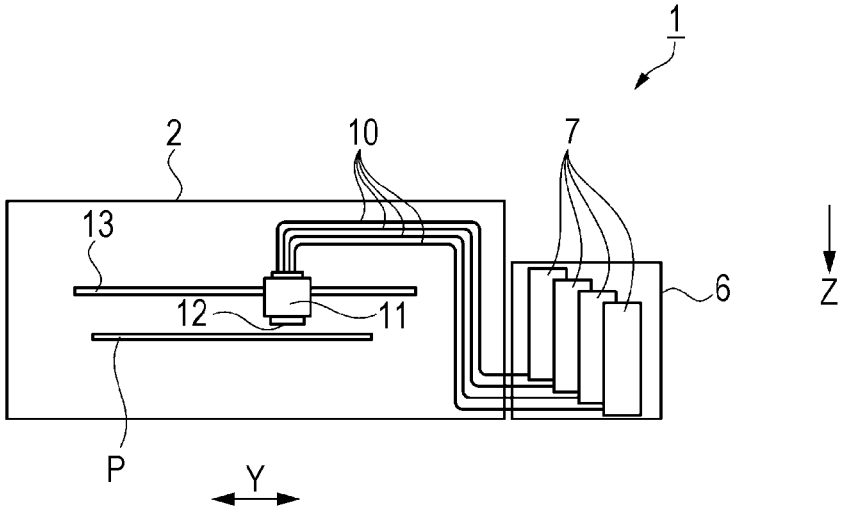

FIG. 1B is an illustrative diagram showing an overall internal structure of the printer 1. Inside the printer 1 there is provided a carriage 11 that moves back and forth over a print sheet P. On a bottom surface side of the carriage 11 (a side thereof facing the print sheet P) there is mounted a liquid ejecting head 12 that is provided with a plurality of ejection nozzles (not shown). Inks are ejected from the ejection nozzles to the print sheet P.

The ink tanks 7 and the liquid ejecting head 12 are interconnected by flexible liquid tubes 10. The inks contained in the ink tanks 7 are supplied to the liquid ejecting head 12 through the liquid tubes 10.

The carriage 11 repeatedly moves back and force in main scanning directions (width directions Y of the body case 2) over the print sheet P as the carriage 11 is driven by a drive mechanism (not shown) while being guided by a guide rail 13. Furthermore, the printer 1 includes a transport mechanism (not shown) for transporting the print sheet P. In accordance with the back-and-forth movements of the carriage 11, the print sheet P is transported in a subsidiary scanning direction (a depth direction X of the body case).

The printer 1 also includes a printing mechanism that ejects the inks from the liquid ejecting head 12 in accordance with the back-and-forth movement of the carriage 11 and the transport movement of the print sheet P and thereby prints characters and images on the print sheet P.

Figure 2A:
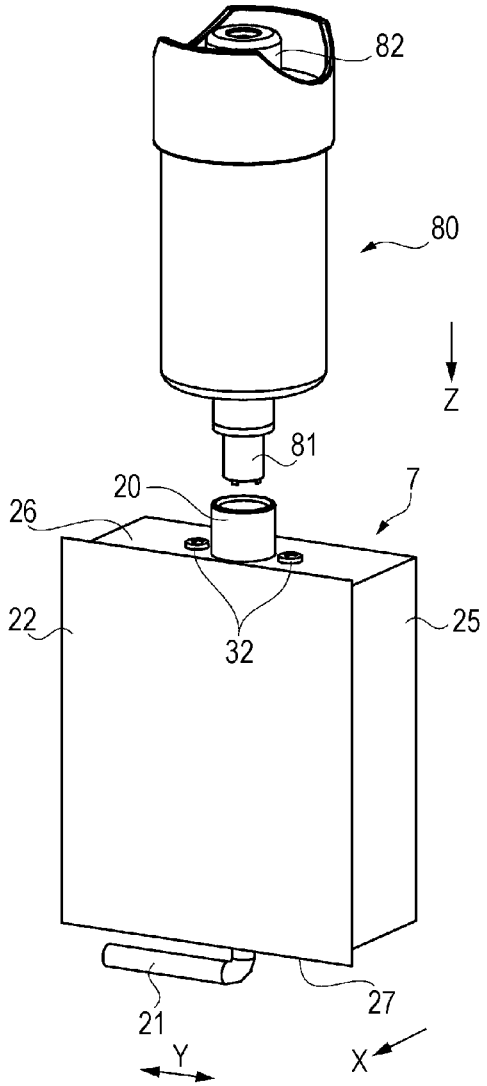
FIG. 2A is a perspective view of an ink container and an ink tank and FIG. 2B is a perspective view showing an interior of the ink tank.

FIG. 2A is a perspective view of an ink container 80 and an ink tank 7. The ink container 80 has a hollow cylindrical pour port 81 and an open-to-atmosphere button 82. An upper end portion of the ink tank 7 is provided with a fill port-guiding wall 20 and a bottom portion of the ink tank 7 is provided with an ink-leading-out portion 21 that is connected to a corresponding one of the liquid tubes 10.

When a cap 8 as shown in FIG. 1A is removed, the fill port-guiding wall 20 as shown in FIG. 2A is exposed. Therefore, the user removes the cap 8, inserts the pour port 81 of the ink container 80 to an inside of the fill port-guiding wall 20, and charges the ink into the ink tank 7. The fill port-guiding wall 20 has a hollow cylindrical shape protruded from the upper end portion of the ink tank 7 and guides the pour port 81 of the ink container 80 to a position above a fill port 34 (see FIG. 3A).

Figure 2B:
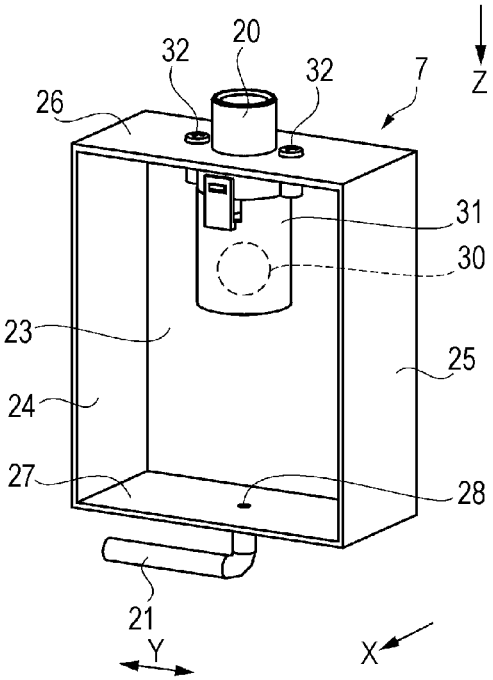

FIG. 2B is a perspective view showing an interior of the ink tank 7, with a wall portion 22 of the ink tank 7 removed. The ink tank 7 is a box-shaped liquid container formed by wall portions 22 and 23 that face each other in the depth direction X and wall portions 24 and 25 that face each other in the width directions Y, and an upper wall portion 26 and a bottom wall portion 27 that face each other in a vertical direction Z.

At an upper side inside the ink tank 7 there is a hollow cylindrical guide portion 31 fixed to the upper wall portion 26 by two screws 32. Inside the guide portion 31 there is provided a spherical float 30 that is movable upward and downward in the vertical direction Z. The bottom wall portion 27 is provided with a through hole 28 that communicates with the ink-leading-out portion 21.

Figure 3A:
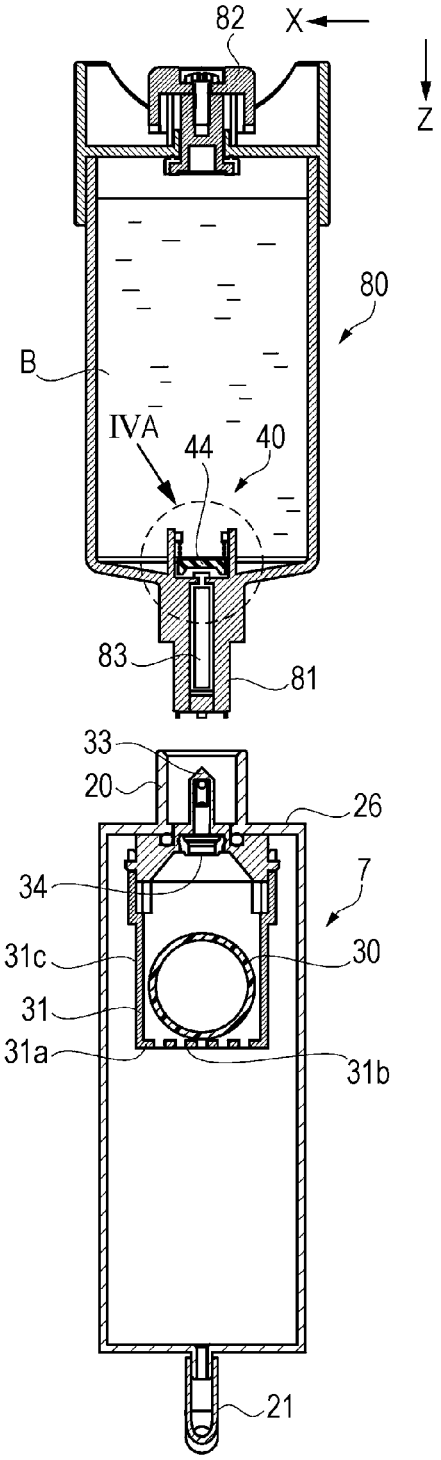
FIGS. 3A and 3B are sectional views of the ink container and the ink tank.
Figure 3B:
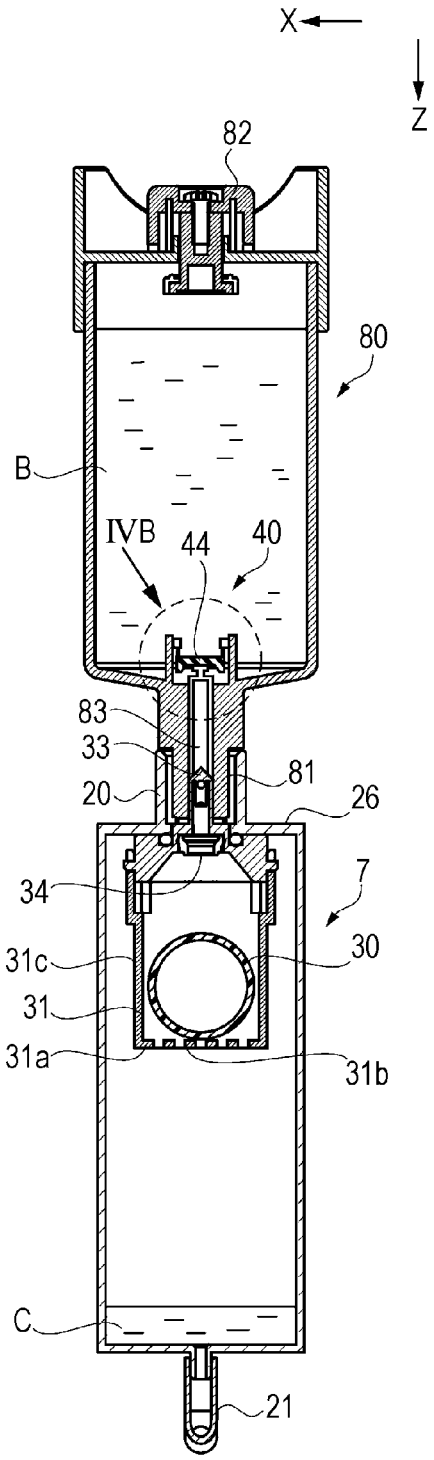

FIGS. 3A and 3B are sectional views of the ink container 80 and the ink tank 7 seen from one of width directions Y indicated in FIG. 1A. FIG. 3A shows a state before the pour port 81 of the ink container 80 is inserted inside the fill port-guiding wall 20 of the ink tank 7. FIG. 3B shows a state in which the pour port 81 of the ink container 80 has been inserted inside the fill port-guiding wall 20 of the ink tank 7.

The pour port 81 of the ink container 80 is provided with a self-sealing valve 40. Inside the fill port-guiding wall 20 of the ink tank 7 there is provided a projected portion 33 that protrudes upward in a hollow cylindrical shape from the upper wall portion 26. The projected portion 33 has, in its upper and lower portions, opening portions, and also has a hollow portion inside which the ink B passes. In the state shown in FIG. 3B in which the pour port 81 of the ink container 80 has been inserted inside the fill port-guiding wall 20 of the ink tank 7, the pour port 81 and the ink tank 7 communicate with each other so that the ink B can be poured from the pour port 81 into the ink tank 7.

The pour port 81 of the ink container 80 has therein a hollow cylindrical member 83 that is movable in up-down directions. In the state shown in FIG. 3A in which the pour port 81 has not yet been inserted inside the fill port-guiding wall 20, the hollow cylindrical member 83 is at a lower position. In the state shown in FIG. 3B in which the pour port 81 has been inserted inside the fill port-guiding wall 20, the hollow cylindrical member 83 has been pushed to an upper position by the projected portion 33.

Figure 4A:
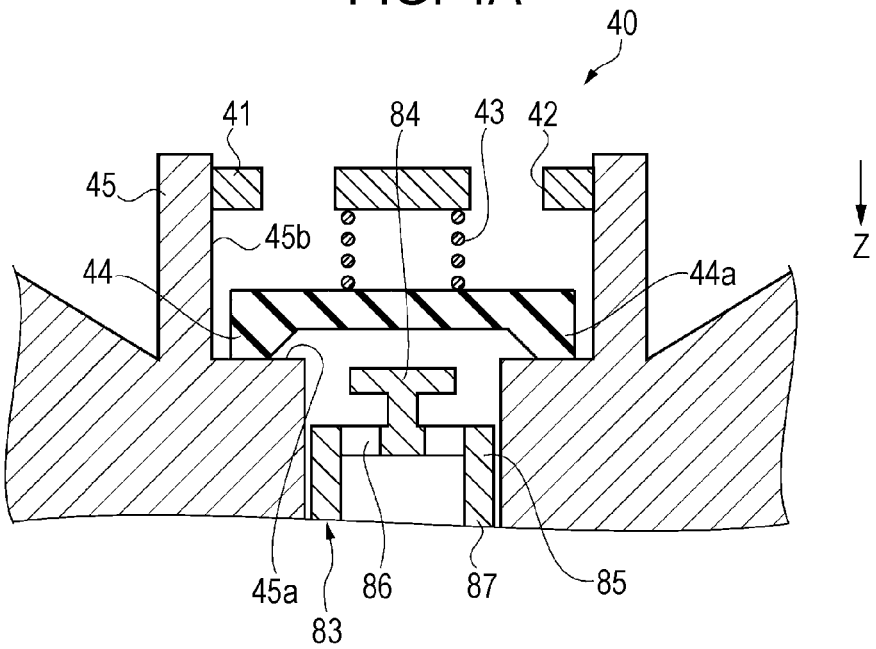
FIGS. 4A and 4B are sectional views for describing an operation of a self-sealing valve.
Figure 4B:
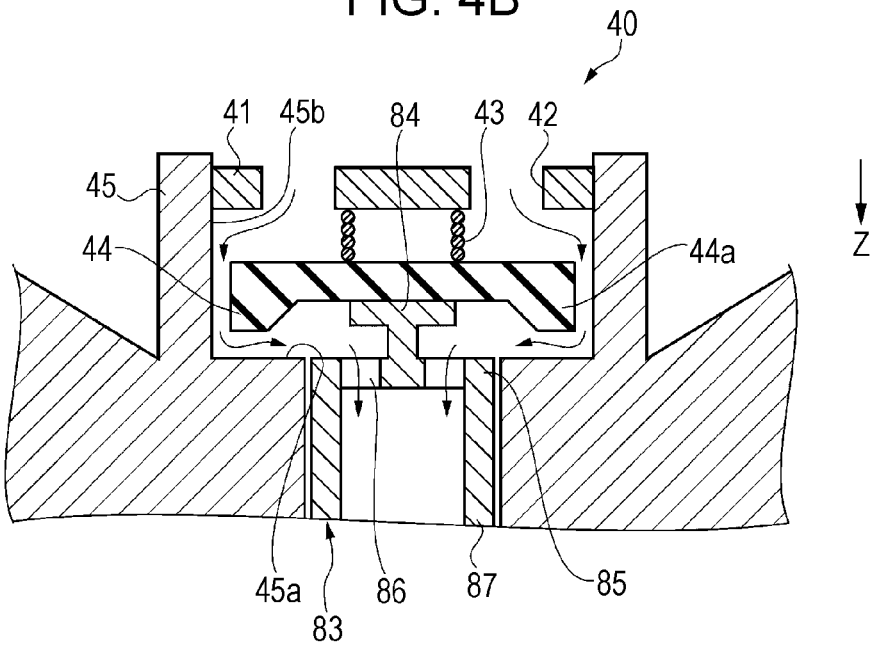

FIGS. 4A and 4B are sectional views for describing an operation of the self-sealing valve 40. FIG. 4A is an enlarged view of portions circled by an interrupted line IVA in FIG. 3A, showing a state in which the pour port 81 has not yet been inserted inside the fill port-guiding wall 20 and the self-sealing valve 40 has been closed. FIG. 4B is an enlarged view of portions circled by an interrupted line IVB in FIG. 3B, showing a state in which the pour port 81 has been inserted inside the fill port-guiding wall 20 and therefore the self-sealing valve 40 has been pushed to open by the hollow cylindrical member 83.

Inside a wall portion 45 having a hollow cylindrical shape there are provided a valve 44 whose outer perimeter portion has a protruded portion 44*a* that protrudes downward, a fixed member 41, and a coiled spring member 43. The fixed member 41 has a plurality of through holes 42. An outer peripheral portion of the fixed member 41 is fixed to an inner wall surface of the wall portion 45.

In the state shown in FIG. 3A in which the pour port 81 of the fill port-guiding wall 20 has not yet been inserted inside the fill port-guiding wall 20, the valve 44 is, as shown in FIG. 4A, in a state of being pressed downward by the spring force of the coiled spring member 43 fixed to the fixed member 41, with the protruded portion 44*a* of the valve 44 pressing a bottom surface 45*a* of the wall portion 45. Therefore, in this state, the ink B does not flow inside the self-sealing valve 40.

In FIG. 3A, the open-to-atmosphere button 82 is at an upper position and the inside of the ink container 80 is not open to the atmosphere. In the state shown in FIG. 4A, the self-sealing valve 40 is closed. Therefore, in this state, the ink B does not flow out of the ink container 80.

In the state shown in FIG. 3B in which the pour port 81 has been inserted inside the fill port-guiding wall 20, the hollow cylindrical member 83 is at the upper position as stated above. As shown in, for example, FIG. 4B, the hollow cylindrical member 83 includes a protruded portion 84 that is supported by an upper-side wall portion 85 and that is protruded upward from the wall portion 85. The wall portion 85 has a plurality of through holes 86.

When the hollow cylindrical member 83 is at the upper position, the valve 44 is, as shown in FIG. 4B, in a state of being pressed upward by the protruded portion 84 of the hollow cylindrical member 83. The force by which the hollow cylindrical member 83 presses the valve 44 upward is greater than the downward spring force of the coiled spring member 43, so that the valve 44 is at such a position that the protruded portion 44*a* of the valve 44 is apart from the bottom surface 45*a* of the wall portion 45. Therefore, in this state, the ink flows inside the self-sealing valve 40.

In the state shown in FIG. 3B, the open-to-atmosphere button 82 of the ink container 80 has been depressed downward by a user so that the inside of the ink container 80 is open to the atmosphere, and the self-sealing valve 40 has been opened.

Therefore, as indicated by arrows in FIG. 4B, the ink passes through the through holes 42 of the fixed member 41, a space between the valve 44 and an inner peripheral surface 45*b* of the wall portion 45, a space between the valve 44 and the bottom surface 45*a* of the wall portion 45, and the through holes 86 formed in the upper-side wall portion 85 of the hollow cylindrical member 83. Due to this configuration, in the state shown in FIG. 3B in which the pour port 81 of the ink container 80 has been inserted inside the fill port-guiding wall 20, the ink B flows out of the ink container 80 and is stored in the ink tank 7 as an ink C.

As shown in FIGS. 3A and 3B, a float 30 is at a position at which the float 30 is supported by a bottom portion 31*a* of the guide portion 31 that has a hollow cylindrical shape. The float 30 in this exemplary embodiment as an example has been formed from a resin material sheet having a thickness of about 1.3 mm so as to have a spherical shape. The float 30 has an internal space filled with air and has a diameter of about 30 mm.

Figure 5:
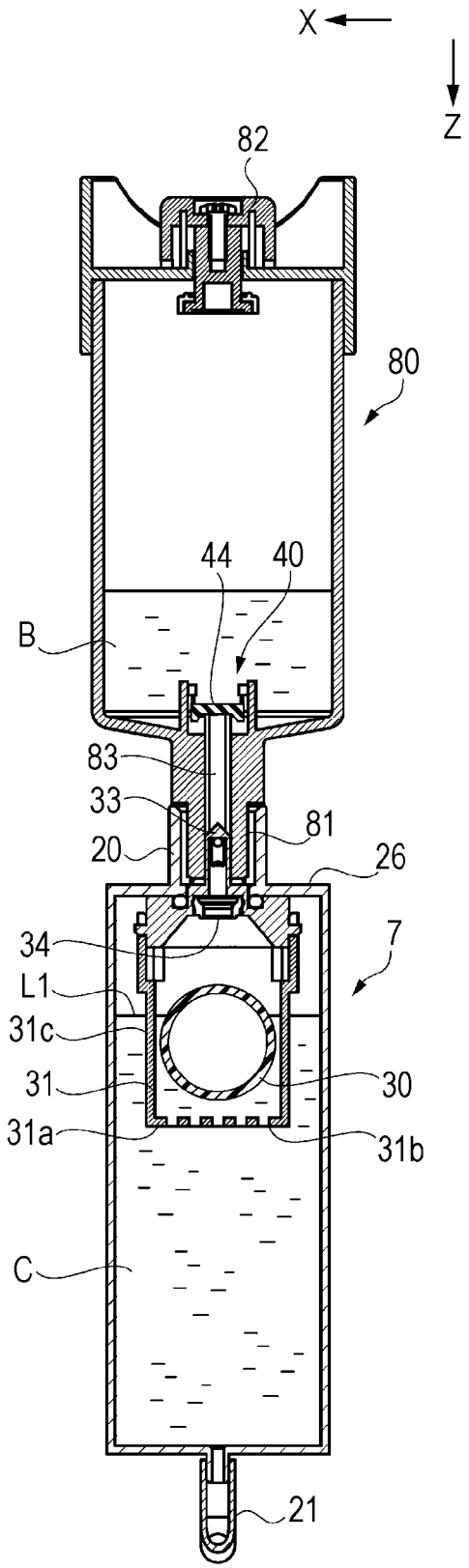
FIG. 5 is a sectional view showing a state in which a liquid surface of ink stored in the ink tank has reached a position on a central portion of a guide portion.

FIG. 5 is a sectional view showing a state in which a liquid surface L1 of the ink C stored in the ink tank 7 has reached a position on a middle portion of the guide portion 31. The bottom portion 31*a* of the guide portion 31 has a plurality of through holes 31*b*. As the liquid surface of the ink C rises, the ink C enters the inside of the guide portion 31 through the through holes 31*b*. Incidentally, an upper portion of the guide portion 31 has a communication hole (not shown in the drawings) that provides communication between a space inside the guide portion 31 and a space that is outside the guide portion 31 and inside the ink tank 7. Air passes through this communication hole.

Therefore, the float 30 leaves the bottom portion 31*a* and moves upward by buoyancy. When moving upward, the float 30 is guided by an outer perimeter wall portion 31*c* of the guide portion 31 and therefore restricted in the horizontal position.

Figure 6:
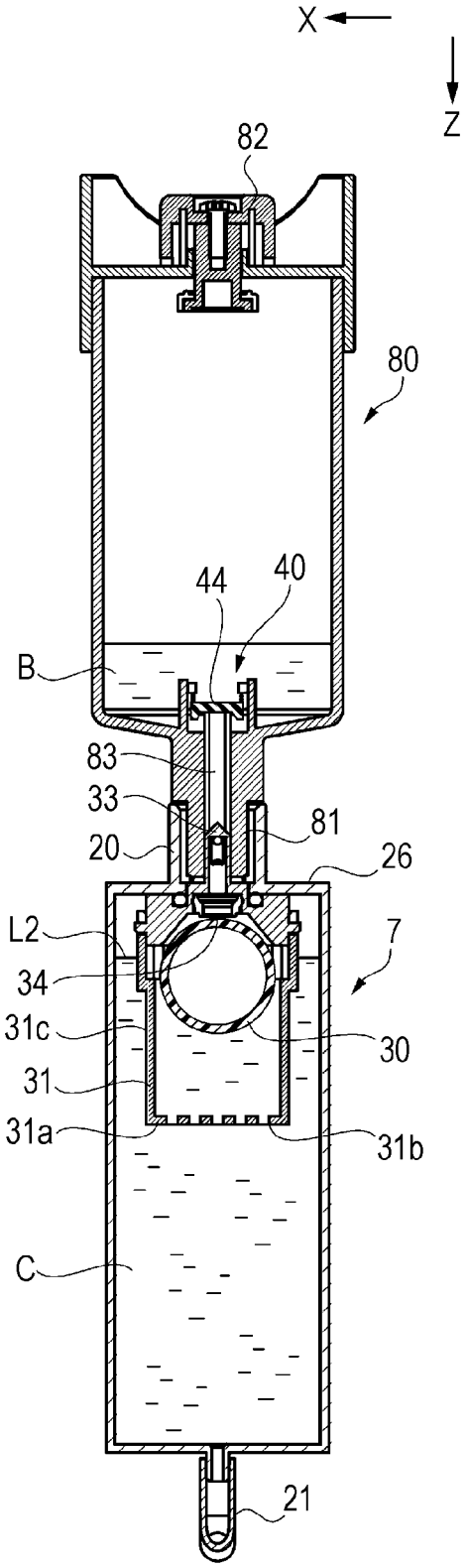
FIG. 6 is a sectional view showing a state in which the liquid surface of the ink stored in the ink tank has reached a position on an upper portion of the guide portion.

FIG. 6 is a sectional view showing a state in which the ink B in the ink container 80 has been poured into the ink tank 7 and the liquid surface L2 of the ink C in the ink tank 7 has reached a position on an upper portion of the guide portion 31. When the liquid surface L2 of the ink C reaches the position on the upper portion of the guide portion 31, the float 30 contacts the fill port 34 as shown in FIG. 6.

Therefore, the fill port 34 is closed by the float 30, so that the pour of the ink B from the ink container 80 into the ink tank 7 stops.

Thus, the printer 1 described above in conjunction with this exemplary embodiment includes the ink tank 7 that has the fill port 34 for the user to pour in ink through, the printing mechanism that performs printing by using the ink from the ink tank 7, and the float 30 that floats in the ink inside the ink tank 7. The fill port 34 is closed by the float 30 floating up.

According to this configuration, the pour of ink stops at the time point when a proper amount of ink is poured into the ink tank 7.

Furthermore, the printer 1 also has, above the fill port 34, the projected portion 33 for allowing the ink to pass by opening the self-sealing valve 40 of the ink container 80 when the ink container 80, guided by the fill port-guiding wall 20, is set to the fill port 34.

Because the self-sealing valve 40 of the ink container 80 is opened when the ink container 80 is set to the fill port 34, it is possible to prevent an incident in which ink is spilled around the fill port 34 when a user tilts the ink container 80 to start pouring in ink. Furthermore, when the ink container 80 is detached from the fill port 34 after the fill port 34 is closed by the float 30 floating up, the self-sealing valve 40 of the ink container 80 closes, so that the incident of the ink being spilled around the fill port 34 can be prevented.

Furthermore, the printer 1 also includes the guide portion 31 that guides the float 30 upward in the vertical direction Z. Therefore, the float 30 is guided to the fill port 34.

Furthermore, the fill port 34 is closed by the float 30 contacting the fill port 34. That is, the float 30 functions as a valve for closing the fill port 34. Thus, the closure of the fill port 34 can be achieved by a simple configuration.

Figure 7A:
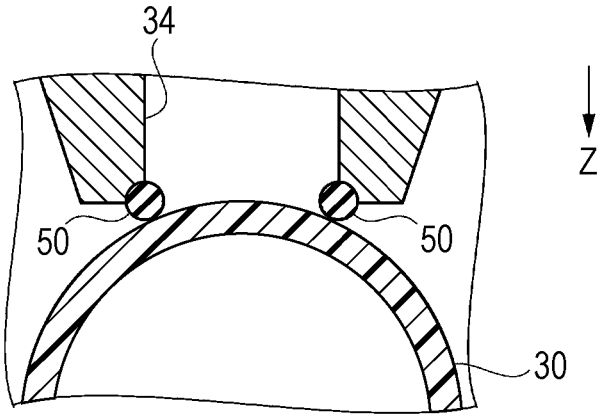
FIG. 7A is a diagram of a portion that includes an elastic member on a lower portion of the fill port and FIG. 7B is a portion that includes an elastic member on an upper portion of a float.

As shown in FIG. 7A, a ring-shaped elastic member 50 made of rubber or the like may be provided on a lower portion of the fill port 34 that the float 30 contacts. This will improve the tightness of closure of the fill port 34 with the float 30.

Figure 7B:
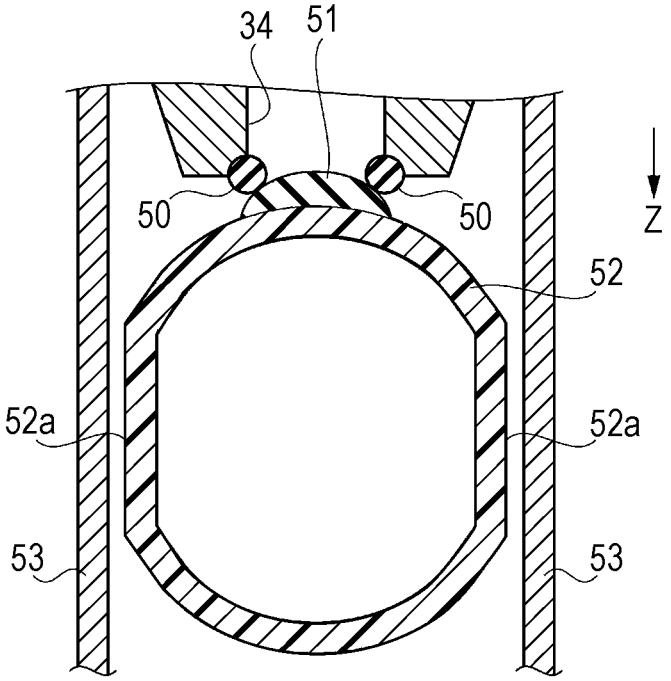

As shown in FIG. 7B, another elastic member 51 made of rubber or the like may be provided on an upper portion of the float 52 so as to contact the elastic member 50 provided on a lower portion of the fill port 34. This will further improve the tightness of closure between the fill port 34 and the float 52 via the elastic members 50 and 51. It is also appropriate that end portions of the float 52 in the left-right direction in FIG. 7B be provided with flat portions 52*a* extending in the vertical direction Z so that the guide portions 53 guide the float 52 in the vertical direction Z to keep the posture of the float 52.

Embodiment 2

Figure 8:
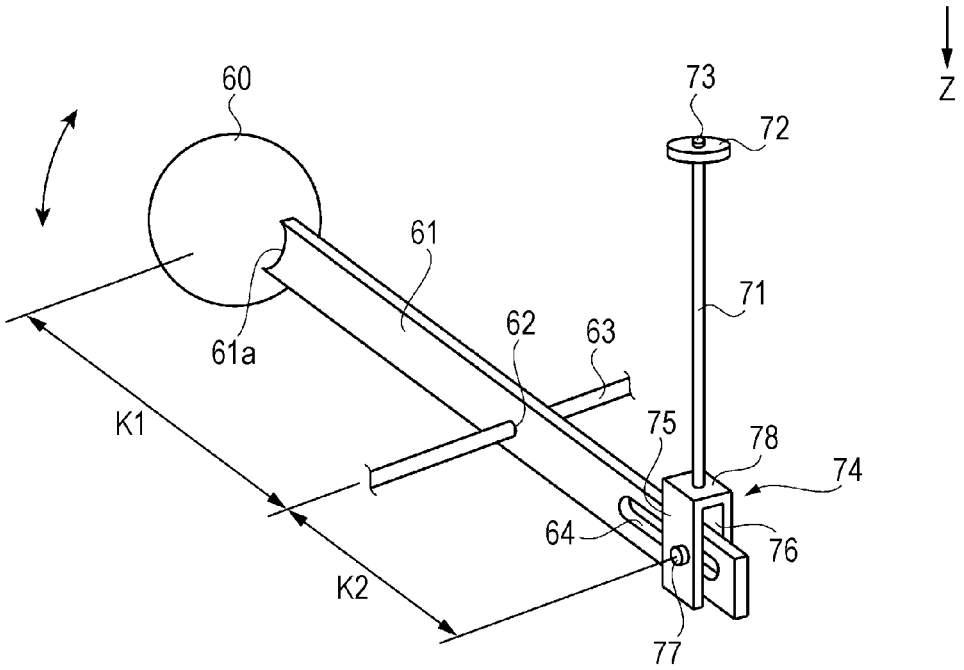
FIG. 8 is a perspective view showing a float fixed to an end portion of a pivoting member.

In Embodiment 2, using the principle of leverage, the fill port of an ink tank is closed. FIG. 8 is a perspective view showing a float 60 fixed to an end portion 61*a* of a pivoting member 61.

The pivoting member 61 is provided with a through hole 62 through which a cylindrical support member 63 fixed to an interior of an ink tank (not shown) extends. The pivoting member 61 pivots as indicated by arrows, with the support member 63 serving as a pivot fulcrum.

The end portion 61*a* of the pivoting member 61 is fixed to an outer peripheral surface of the spherical float 60. An opposite end portion of the pivoting member 61 to the float 60 has an elongated hole 64 that is elongated in a lengthwise direction of the pivoting member 61.

A lower portion of a rod-shaped member 71 extending in a vertical direction Z is provided with a connection portion 74 that is connected to the elongated hole 64 of the pivoting member 61. The connection portion 74 is made up of a support plate 78 fixed to an end portion of the rod-shaped member 71, facing plates 75 and 76 that are fixed to the support plate 78 and that face each other across a space therebetween, and a narrow cylindrical member 77 connecting the facing plates 75 and 76.

The end portion of the pivoting member 61 in which the elongated hole 64 is formed is placed at such a position as to be sandwiched between the facing plates 75 and 76 of the rod-shaped member 71 and the cylindrical member 77 extends through the elongated hole 64, so that the rod-shaped member 71 and the pivoting member 61 are connected to each other. The cylindrical member 77 is movable within the elongated hole 64. The opposite end portion of the rod-shaped member 71 to the connection portion 74 is fixed to a circular disk-shaped valve portion 72. An upper portion of the valve portion 72 is provided with a protruded portion 73.

A distance K1 from a center portion of the float 60 to a center portion of the through hole 62 is longer than a distance K2 from the position of a center axis of the cylindrical member 77 to the center position of the through hole 62. Because of the principle of leverage, the cylindrical member 77 receives a force (downward force in the vertical direction Z) that is greater than the buoyant force exerted on the float 60 (upward force in the vertical direction Z).

Figure 9A:
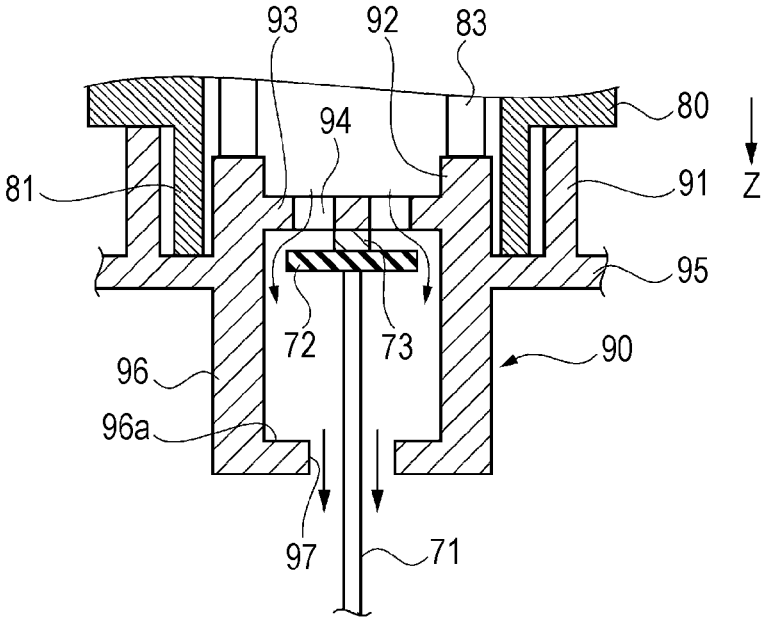
FIGS. 9A and 9B are sectional views showing an upper portion of a fill port of an ink tank and a pour port of an ink container which has been set to the upper portion of the fill port.
Figure 9B:
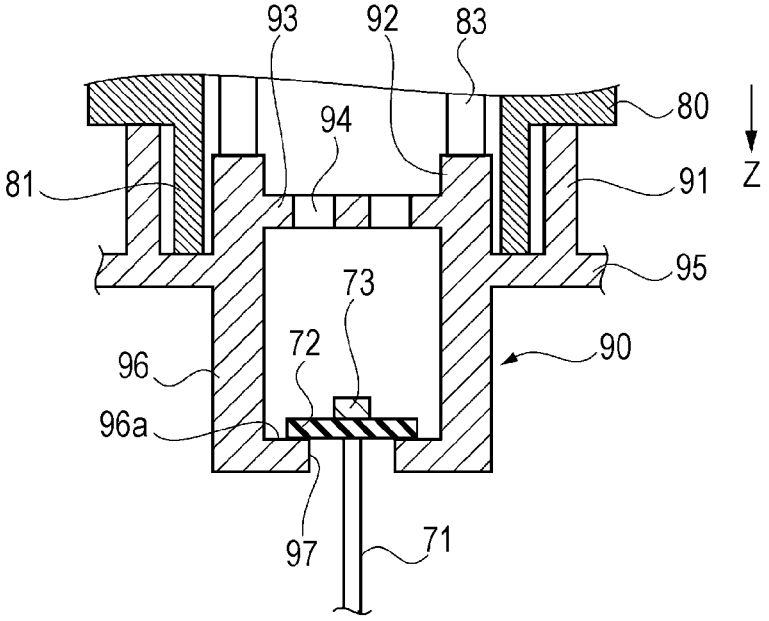

FIGS. 9A and 9B are sectional views in which the pour port 81 of the ink container 80 has been set to a fill port 90 of an ink tank. A fill port-guiding wall portion 91 stands in a hollow cylindrical shape from an upper wall portion 95 of the ink tank. The pour port 81 of the ink container 80 is inserted inside the fill port-guiding wall portion 91.

Inside the fill port-guiding wall portion 91, a projected portion 92 having a hollow cylindrical shape is protruded upward from the upper wall portion 95 at such a position as to be inside the pour port 81 of the ink container 80 when the pour port 81 is inserted inside the fill port-guiding wall portion 91.

When the pour port 81 of the ink container 80 is inserted inside the fill port-guiding wall portion 91, the hollow cylindrical member 83 of the ink container 80 is moved to the upper position by the projected portion 92. Thus, the self-sealing valve 40 assumes an open state (see FIG. 4B).

The fill port 90 has a hollow cylindrical wall portion 96. An upper portion of the hollow cylindrical wall portion 96 is provided with a circular disk-shaped member 93 and a lower portion of the hollow cylindrical wall portion 96 is provided with an opening portion 97. The circular disk-shaped member 93 has a plurality of through holes 94.

The upper portion of the valve portion 72 is provided with the protruded portion 73. When the liquid surface of the ink in the ink tank is low, the float 60 shown in FIG. 8 is at a lower position. Therefore, the rod-shaped member 71 and the valve portion 72 are, as shown in FIG. 9A, at an upper position such that the protruded portion 73 is in contact with the circular disk-shaped member 93. At this time, because of the weight of the float 60 and others, the protruded portion 73 presses the circular disk-shaped member 93. Incidentally, a coiled spring member may be provided so as to cause the protruded portion 73 to press the circular disk-shaped member 93.

When the valve portion 72 is at the upper position shown in FIG. 9A, the ink passes through the through holes 94, a space between the valve portion 72 and the inner peripheral surface of the hollow cylindrical wall portion 96, and the opening portion 97 as indicated by arrows in FIG. 9A, so that the ink in the ink container 80 is poured into the ink tank.

As the liquid surface of the ink in the ink tank rises, the position of the float 60 shown in FIG. 8 shifts to a higher position. Therefore, the rod-shaped member 71 and the valve portion 72 are, as shown in FIG. 9B, at a lower position such that the valve portion 72 is in contact with a bottom surface 96*a* of the hollow cylindrical wall portion 96.

Thus, the opening portion 97 is closed by the valve portion 72, so that the pour of the ink stops.

The cylindrical member 77 shown in FIG. 8 is movable in the elongated hole 64 in its lengthwise direction. Therefore, when the pivoting member 61 pivots, the rod-shaped member 71 does not incline relative to the vertical direction Z. Therefore, the valve portion 72 can fully contact the bottom surface 96*a* of the hollow cylindrical wall portion 96.

In this exemplary embodiment, the float 60 is fixed to the pivoting member 61 at a position remote from the support member 63 that serves as the pivot fulcrum of the pivoting member 61 and, by the principle of leverage, the acting force converted from the buoyant force on the float 60 acts to close the opening portion 97 of the fill port 90.

According to this configuration, because of the principle of leverage, the acting force for closing the opening portion 97 of the fill port 90 can be made greater than the buoyant force on the float 60. Therefore, the volume of the float 60 can be made small.

Embodiment 3

Figure 10A:
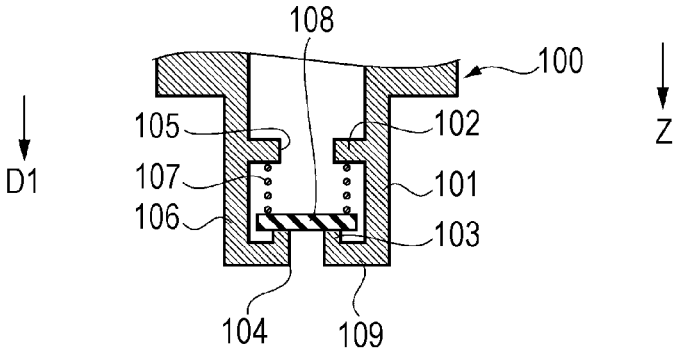
FIG. 10A is a sectional view of a portion of a pour port of an ink container and FIGS. 10B and 10C are sectional views of the pour port of the ink container set to an upper portion of a filing port of an ink tank.

In Embodiment 3, the principle of leverage is utilized to close a pour port of an ink container. FIG. 10A is a sectional view of portions of an ink container 100 which include a pour port 101. The pour port 101 shown in FIG. 10A is in a state before the pour port 101 is set to an upper portion of a fill port 122 of an ink tank 120 (see FIG. 10B).

The pour port 101 of the ink container 100 has a wall portion 106 that has a hollow cylindrical shape. An inner wall of an upper portion of the wall portion 106 has a ring-shaped protruded portion 102 that is provided with an opening portion 105. An inner wall of a lower portion of the wall portion 106 has a ring-shaped protruded portion 103 that is protruded upward from a bottom wall 109.

A coiled spring member 107 is disposed between the protruded portion 102 and a valve portion 108. The coiled spring member 107 urges the valve portion 108 in a direction D1. Therefore, the valve portion 108 presses the protruded portion 103 to close an opening portion 104 that is formed in the bottom wall 109. The coiled spring member 107 and the valve portion 108 disposed inside the wall portion 106 constitute a self-sealing valve.

Figure 10B:
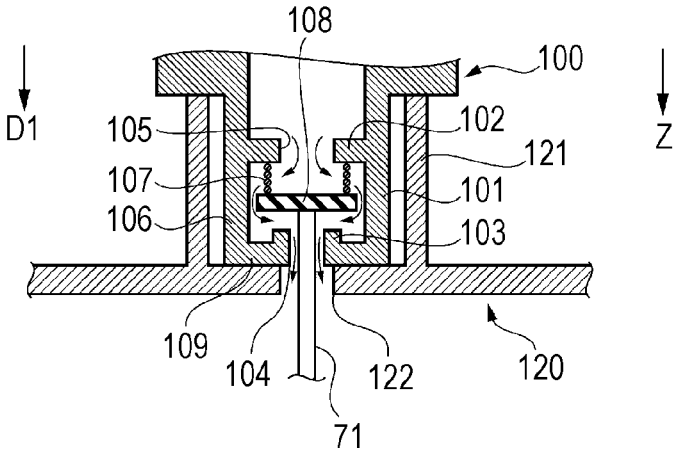
Figure 10C:
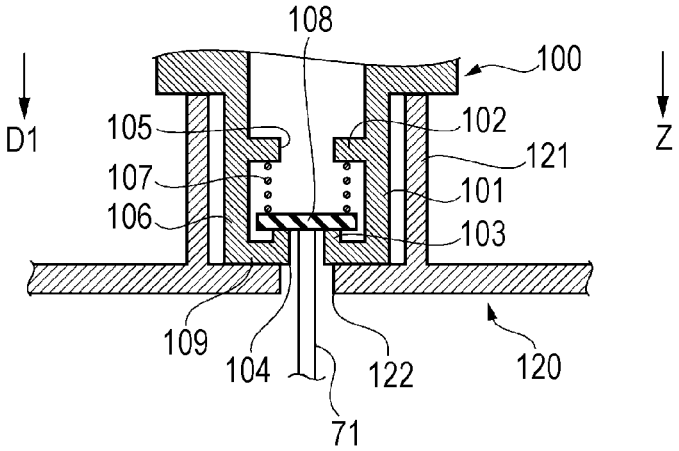

FIGS. 10B and 10C are sectional views showing states in which the pour port 101 of the ink container 100 has been set over a fill port 122 of an ink tank 120. A fill port-guiding wall portion 121 of the ink tank 120 has a hollow cylindrical shape and is provided above the fill port 122. The pour port 101 of the ink container 100 is inserted inside the fill port-guiding wall portion 121 provided above the fill port 122.

When the liquid surface of ink in the ink tank is low, the float 60 shown in FIG. 8 is at a lower position. In this exemplary embodiment, similar to but different from the configuration described above with reference to FIG. 8, the valve portion 72 and the protruded portion 73 are separate from the upper portion of the rod-shaped member 71.

When the float 60 is at a lower position, the weight of the float 60 and others causes the rod-shaped member 71 to assume a state as shown in FIG. 10B, that is, extend through the fill port 122 and the opening portion 104 of the pour port 101 and reach a position above the protruded portion 103 protruded upward from the bottom wall 109. Therefore, the rod-shaped member 71 pushes the valve portion 108 upward to an upper position, overcoming the spring force of the coiled spring member 107 acting in the direction D1.

Therefore, the valve portion 108 is at a position apart from the protruded portion 103 protruded upward from the bottom wall 109. When the valve portion 108 is apart from the protruded portion 103, the ink passes through the opening portion 105, a space between the valve portion 108 and the wall portion 106, and the opening portion 104 as indicated by arrows in FIG. 10B, and is poured into the ink tank 120.

As the liquid surface of the ink in the ink tank 120 rises, the float 60 shown in FIG. 8 receives buoyant force in an upward direction. Therefore, because of the principle of leverage, the rod-shaped member 71 receives downward force. Hence, the valve portion 108 receives a resultant force that includes the spring force of the coiled spring member 107, and moves to a lower position, as shown in FIG. 10C, at which the valve portion 108 contacts the protruded portion 103 and therefore closes the opening portion 104.

In this exemplary embodiment, there is provided a printing apparatus that includes the ink tank 120 that has the fill port 122 for a user to pour in ink through, a printing mechanism that performs printing by using ink stored in the ink tank 120, and the float 60 that floats in the ink in the ink tank 120. The float 60, when floated up, causes closure of the pour port 101 of the ink container 100 which has been inserted inside the fill port-guiding wall portion 121 formed above the fill port 122 of the ink tank 120.

According to this configuration, at the time point when a proper amount of ink is poured into the ink tank 120, the pour of the ink is stopped. Therefore, it is no longer necessary to monitor the position of the liquid surface in the ink tank 120 in order to prevent an incident in which ink overflows from the fill port 122 of the ink tank 120.

Furthermore, the rod-shaped member 71 functions as a projected portion for releasing, that is, opening, the self-sealing valve of the ink container 100 set to the fill port 122 of the ink tank 120. Therefore, in the case where ink is poured from the ink container 100 into the ink tank 120, it is possible to prevent an incident in which the surrounding of the fill port 122 of the ink tank 120 is smeared with ink when the pour port 101 of the ink container 100 is set to an upper portion above the fill port 122 of the ink tank 120 or when the pour port 101 is detached from the upper portion above the fill port 122.

Note that the float is not limited to the floats described above. The float may be solid instead of hollow and may also be of a spherical shape, a cylindrical shape, a gourd shape, and various other shapes.

The ink container may be of a soft bag or the like.

Although in this exemplary embodiment, the printer 1 is of a so-called serial mode, the printer 1 may be of a line mode or the like. Furthermore, the ink tank is not limited to ink tanks that are provided outside the printer 1 but may be ink tanks that are provided inside the printer 1. The number of kinds of inks and the number of ink tanks are not limited to four but may be any number greater than or equal to one.

What is claimed is:

1. A printing apparatus comprising:

an ink tank that has at least first, second, third wall portions that define a space to contain ink, and has a fill port for a user to pour in ink through, the fill port being arranged at the first wall portion, the second wall portion facing in an opposite direction of the first wall portion, the third wall portion being arranged between the first and second wall portions;

a printing mechanism that performs printing by using ink stored in the ink tank;

a float that floats in the ink in the ink tank; and a guide member that guides the float, the guide member being spaced apart from the third wall portion in the ink tank, the fill port being closed as the float floats up.

2. The printing apparatus according to claim 1, wherein the ink tank further has a guiding portion that protrudes upward from the first wall portion, and a projected portion that is configured to open a self-sealing valve of an ink container set to the fill port, the projected portion being provided above the fill port, at least part of the projected portion being disposed inside of the guide portion.

3. The printing apparatus according to claim 1, wherein the guide member guides the float upward in a vertical direction.

4. The printing apparatus according to claim 1, wherein the float closes the fill port by contacting the fill port.

5. The printing apparatus according to claim 4, wherein a site at the fill port with which the float comes into contact is provided with an elastic member that enables tight closure with the float.

6. The printing apparatus according to claim 1, further comprising a pivoting member whose pivot fulcrum is fixed in the ink tank, wherein the float is fixed to the pivoting member at a position apart from the pivot fulcrum, and wherein by a principle of leverage, an acting force converted from a buoyant force on the float causes the fill port to be closed.

7. A printing apparatus comprising:

an ink tank that has a fill port for a user to pour in ink through;

a printing mechanism that performs printing by using ink stored in the ink tank;

a float that floats in the ink in the ink tank;

a rod-shaped member that is partially positioned in a pour port of an ink container while the pour port is set to the fill port, the rod-shaped member moving as the float floats up such that the pour port of the ink container set to the fill port is closed in response to the moving of the rod-shaped member.

8. The printing apparatus according to claim 7, further comprising a pivoting member whose pivot fulcrum is fixed in the ink tank, wherein the float is fixed to the pivoting member at a position apart from the pivot fulcrum, and wherein by a principle of leverage, an acting force converted from a buoyant force on the float causes the fill port to be closed.

* * * * *